US008403582B2

(12) United States Patent
Bischoff

(10) Patent No.: US 8,403,582 B2
(45) Date of Patent: Mar. 26, 2013

(54) APPARATUS FOR TREATING A STAIN IN CLOTHING

(75) Inventor: Corey Michael Bischoff, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 88 days.

(21) Appl. No.: 13/169,465

(22) Filed: Jun. 27, 2011

(65) Prior Publication Data

US 2012/0000809 A1 Jan. 5, 2012

Related U.S. Application Data

(60) Provisional application No. 61/360,016, filed on Jun. 30, 2010.

(51) Int. Cl.
*B65D 75/00* (2006.01)

(52) U.S. Cl. ..... 401/133; 401/132; 401/261; 8/137

(58) Field of Classification Search ..... 401/132, 401/133

See application file for complete search history.

(56) References Cited

U.S. PATENT DOCUMENTS

| | | | | |
|---|---|---|---|---|
| 4,140,409 | A | 2/1979 | DeVries | |
| 4,430,013 | A | 2/1984 | Kaufman | |
| 4,493,574 | A | 1/1985 | Redmond et al. | |
| 5,380,110 | A | 1/1995 | Festa | |
| 5,487,932 | A | 1/1996 | Dunshee | |
| 5,840,675 | A | 11/1998 | Yeazell | |
| 6,007,264 | A | 12/1999 | Koptis | |
| 6,832,867 | B2 | 12/2004 | Sandbach et al. | |
| 7,506,762 | B2 * | 3/2009 | Nelson et al. | 206/484.1 |
| 7,552,823 | B2 | 6/2009 | Schuehrer | |
| 8,028,837 | B2 | 10/2011 | Gerstle et al. | |
| 8,113,730 | B2 * | 2/2012 | Maloney et al. | 401/133 |
| 2005/0160543 | A1 | 7/2005 | Catalfamo et al. | |
| 2007/0183836 | A1 | 8/2007 | Lampe et al. | |
| 2008/0230298 | A1 | 9/2008 | Buch et al. | |
| 2010/0065582 | A1 | 3/2010 | Nelson et al. | |
| 2010/0264044 | A1 | 10/2010 | Beihoffer et al. | |
| 2011/0162151 | A1 * | 7/2011 | Chawla et al. | 8/137 |
| 2011/0167568 | A1 * | 7/2011 | Littig et al. | 8/137 |
| 2011/0167569 | A1 | 7/2011 | Littig et al. | |
| 2011/0167570 | A1 | 7/2011 | Littig et al. | |
| 2011/0170938 | A1 | 7/2011 | Littig et al. | |

FOREIGN PATENT DOCUMENTS

| | | | |
|---|---|---|---|
| WO | WO 2004/046301 | A1 | 6/2004 |
| WO | WO 2005/072594 | A1 | 8/2005 |

OTHER PUBLICATIONS

International Search Report for International Application No. PCT/US2011/042472, mailed Oct. 28, 2011, 7 pages.

Sally Hansen Insta-Smooth Pods Creme Hair Remover, printed from website http://sallyhansen.com/products/hair-removal/lotions-and-creme/insta-smooth%E2%84%A2-pods-creme-hair-remover on Sep. 4, 2012, 2 pages.

* cited by examiner

*Primary Examiner* — Huyen Le
*Assistant Examiner* — Joshua Wiljanen
(74) *Attorney, Agent, or Firm* — Gary J. Foose

(57) ABSTRACT

A package for treating a stained fabric. The package has a contact substrate having a first color and a backing layer having a second color. More than about 25% of each of the widthwise edges of the contact substrate abuts a portion of the backing layer having the second color when the package is in a generally flat position.

19 Claims, 12 Drawing Sheets

APPARATUS FOR TREATING A STAIN IN CLOTHING

CROSS REFERENCE TO RELATED APPLICATIONS

This application claims the benefit of U.S. Provisional Application No. 61/360,016 filed Jun. 30, 2010.

FIELD OF THE INVENTION

Treating stains in clothing.

BACKGROUND OF THE INVENTION

Many consumers experience a stain on their clothing when they are away from home, such as might occur when dining out before a theater engagement. Appearing in public with a clothing stain can be embarrassing to the wearer. If such a stain were to occur at home, the wearer could choose another garment or might be able to effectively treat the stain with a stain treatment system. When away from her house, her options may be limited.

There are presently stain treatment systems, such as pens and wipes, that can be used to apply a stain treatment fluid to a stain and can be used to scrub a stain. One problem associated with such devices is that stains are known to sometimes set in fabric rapidly, thereby making treatment at a later time more difficult. Some stains may even set in fabric to some degree in just a few seconds. Thus, it is important for consumers to be able to rapidly obtain a device to treat the stain and rapidly understand how the device is to be used to treat the stain. Further, when stain treatment devices are presented in a retail environment, not all the attributes of the device are immediately visible to the consumer at the point of selection. For instance, wipes for stains are often packaged in opaque foil wrappers to protect the stain treatment fluid and/or wipe from photo degradation. The consumer cannot see the wipe or see the stain treatment fluid. For stain treatment pens, often the scrubbing tip sometimes has a cap over it and the stain treatment fluid is often in an opaque container. With such arrangements, prior to the consumer actively trying to use the stain treatment system, the consumer has no way to envision how she will use the stain treatment device.

With these limitations in mind, there is a continuing unaddressed need for stain treatment devices that are easy for consumers to understand prior to use and when they need to deploy them rapidly. Further, there is a continuing unaddressed need for stain treatment devices that when presented to a consumer in a retail environment, the consumer can rapidly understand how the device is intended to function, can identify attributes that will aid in stain treatment, and have a better opportunity to recall the attributes at the time she incurs a stain on her clothing.

SUMMARY OF THE INVENTION

A package for treating a stained fabric. The package can comprise a backing layer. The backing layer can have a first side opposing a second side. The backing layer can have a line of weakness. The second side can have a first planar region and a second planar region on opposing sides of the line of weakness. A pouch layer can be joined with the second side of the backing layer thereby forming a pouch. The pouch can contain a stain treatment fluid. The package can further comprise a fluid pervious contact substrate joined to the first side of the backing layer proximal the line of weakness. The package can have a first position in which the first planar region and the second planar region are substantially in plane with one another. The package can have a second position in which the first planar region and the second planar region are in a substantially angularly facing relationship. The stain treatment fluid can comprise from 0.001% to about 99.99%, by weight of the stain treatment fluid, of a surfactant. The contact substrate can have a first color and the first side of the backing layer can have a second color, wherein the first color and the second color are measured by a Hunter Reflectance Meter test according to the colors L*, a*, and b*, with L*, a*, and b* being measured on a surface of the contact substrate oriented away from the first side of the backing layer. The contact substrate can extend between a pair of opposing widthwise edges on opposite sides of the line of weakness. More than about 25% of each of the widthwise edges can abut a portion of the backing layer having the second color when the package is in the first position. The first color and the second color can have a difference in color calculated using L*, a*, and b* values by the formula $\Delta E=[(L^*_X-L^*_Y)^2+(a^*_X-a^*_Y)^2+(b^*_X-b^*_Y)^2]^{1/2}$, wherein the ΔE between the first color and the second color is greater than about 10.

DETAILED DESCRIPTION OF THE INVENTION

As used herein the term "joined" refers to the condition where a first member is attached, or connected, to a second member either directly; or indirectly, where the first member is attached, or connected, to an intermediate member which in turn is attached, or connected, to the second member either directly; or indirectly.

Figure 1:
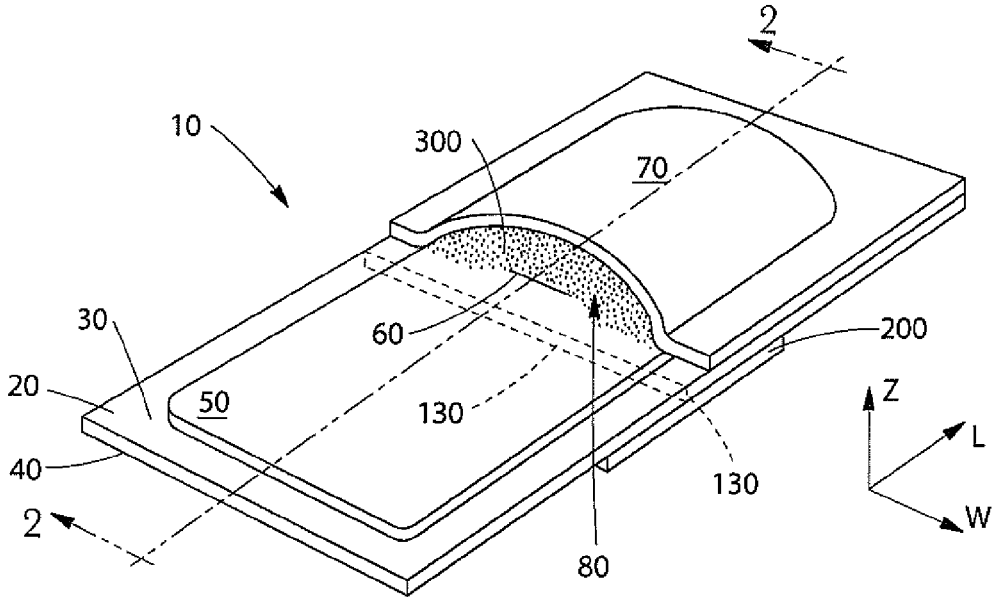
FIG. 1 is a schematic of a cut-away perspective view of a package for treating a stained fabric, the package being in the first position.

A cutaway view of a package 10 for treating a stain in a fabric is shown in FIG. 1. The package 10 may have any generally planar shape including a rectangle, a square, a circle, an oval, a triangle, a pentagon, a hexagon, a trapezoid, or any other ergonomically preferred shape. A planar shape of the package 10 can provide for a package 10 that is convenient to store and is easy to securely grip prior to and during use. The package 10 can have a length direction L and a width direction W in plane with the backing layer 20 and a Z direction orthogonal to the length direction L and width direction W. The dimensions of the package 10 can be such that in the length direction L and width direction W, the package has the planar dimensions of, or smaller than, a common wallet sized credit card or wallet sized photograph.

The package 10 can have a backing layer 20. Backing layer 20 can be made of any suitably stiff material including thin plastic materials such as polystyrene, polyethylene, polypropylene, or other polymeric material. Backing layer 20 can be sufficiently stiff to maintain package 10 in a substantially flat configuration during storage and transport. In some embodiments, the package 10 is sized and dimensioned to fit conveniently in a person's wallet, purse, diaper bag, or pocket.

The backing layer 20 has a first side 40 opposing a second side 30, the first side being towards the bottom of the package 10. The backing layer 20 can have a line of weakness 130. The first side 40 of the backing layer 20 can have a line of weakness 130. The line of weakness 130 can permit the backing layer 20 to break along the line of weakness 130 when the backing layer 20 is subjected to a sufficient bending moment. The backing layer 20 can have a first elastic limit.

The line of weakness 130 can be any number of structures that provide for a controlled break in the backing layer 20 when a sufficient bending moment is applied about the line of weakness 130. The line of weakness 130 can be selected from the group consisting of a score, a frangible portion, perforations, a slit, an aperture, and combination thereof. When the package 10 is in a pre-use condition, the structure of the backing layer 20 can have structural integrity across the line of weakness 130. A score can be a scratch, groove, compressed portion, or other structure that structurally weakens the backing layer 20. A frangible portion can be a series of scratches or compressed portions that structurally weaken the backing layer 20 to make a line of weakness 130 that is controllably rupturable when strained. The line of weakness 130 can be a perforation or series of perforations in the backing layer 20. The perforation or series of perforations can be formed by puncturing the backing layer 20 to form the perforation or series of perforations. The line of weakness 130 can be an aperture formed by selectively removing material from the backing layer 20. The line of weakness 130 can be a slit that is formed by cutting the backing layer 20. In use, as the backing layer 20 is folded upon itself about the line of weakness 130, the line of weakness 130 can rupture.

The magnitude of the bending moment needed to rupture the line of weakness can be controlled, for instance, by the depth of the score, spacing of the perforations, dimension of the aperture, dimension of the slit, whichever such structure, or other structure, is employed if such structures are employed. If a score is employed, the score can penetrate into the backing layer 20 by about 8% to about 10% of the thickness of the backing layer 20, the thickness being measured in the Z direction. A score, if employed, can penetrate into the backing layer 20 by less than about 15% of the thickness of the backing layer 20.

The line of weakness 130 can extend between the edges of the backing layer 20, as shown in FIG. 1. The line of weakness 130 can partially extend between the edges of the backing layer 20.

The backing layer 20 can be a material selected from the group consisting of rigid styrene, foil, BAREX (available from BP Chemicals Inc., Naperville, Ill., USA), polyethylene, nylon, polypropylene, and coextrudants and laminates of any of the preceding substances, and combinations thereof. The thickness of the backing layer 20 can be less than about 2 mm, can possibly be less than about 1 mm, and possibly be about 0.1 mm to about 0.5 mm. The backing layer can have a length between about 3 cm to about 10 cm and a width between about 2 cm to about 6 cm. A larger backing layer 20 might be employed for package 10 designed for use at home.

The package 10 can have a contact substrate 200 joined to the first side 40 of the backing layer 20 proximal the line of weakness 130. The contact substrate 200 can be forced into contact with the fabric to be treated during use of the package 10. The bottom of the package 10 is considered to be the side of the package 10 oriented, in use, towards the fabric to be treated.

A coating layer 50 can be joined to and facing the second side 30. The coating layer 50 can be polymer film and have a second elastic limit. The second elastic limit can be greater than the first elastic limit. In other words, the strain to break of the backing layer 20 can be less than the strain to break of the coating layer 50. The coating layer 50 can be a coextruded film, one layer being a barrier layer, such as ethanol vinyl alcohol film, oriented towards the backing layer 20 and the other layer being a linear low density polyethylene film. The coating layer 50 can be a coextruded film, one layer being a barrier layer, such as polyvinyl alcohol film (possibly EVA film which is a copolymer of ethylene and vinyl acetate), oriented towards the backing layer 20 and the other layer being a linear low density polyethylene film.

The coating layer 50 can have a transmitting portion 60. The transmitting portion 60 can be substantially aligned with the line of weakness 130 in backing layer 20. The transmitting portion 60 can be any number of structures that provide for a metering opening through the coating layer 50 when the package 20 is in use. The transmitting portion 60 can be selected from the group consisting of a score, a frangible portion, perforations, a slit, an aperture, and combination thereof. When the package 10 is in a pre-use condition, the transmitting portion 60 can be liquid impervious. A score can be a scratch, groove, or compressed portion that structurally weakens the coating layer 50. A frangible portion can be a series of scratches or compressed portions that structurally weaken the coating layer to make the transmitting portion 60 rupturable when strained. The transmitting portion 60 can be a perforation or series of perforations wherein the coating layer 50 is punctured to create the perforation or series of perforations. The transmitting portion 60 can be an aperture formed by selectively removing material from the coating layer 50. The transmitting portion 60 can be a slit that is formed by cutting or tearing the coating layer 50. The coating layer can have one or more transmitting portions 60. For instance, there can be at least one, at least two, at least three, or more, transmitting portions 60 in the coating layer 50. A plurality of transmitting portions 60 can be practical for providing wider distribution of the stain treatment fluid 300 to the contact substrate 200. A line of weakness 130 can be provided on the first side 40 of backing layer 20, second side 30 of backing layer 20, on both the first side 40 and second side 30 of backing layer 20. A line of weakness 130 can be a physical and/or chemical discontinuity internal to the structure of the backing layer 20 or on a surface of the backing layer 20.

The peripheral edges of the coating layer 50 can be joined to the backing layer 20. The coating layer 50 can be substantially continuously joined to the backing layer 20 in that more than about 75% of the surface of the portion of coating layer 50 facing the second side 30 of backing layer 20 is joined to the second side 30 of backing layer 20. The entire surface of the portion of the coating layer 50 facing the second side 30 of backing layer 20 can be joined to the second side of the backing layer 20.

The package 10 can comprise a pouch layer 70 joined with the coating layer 50 to form a pouch 80 there between, the pouch 80 being defined by the enclosed volume between the pouch layer 70 and the coating layer 50. The pouch layer 70 can be joined directly to the backing layer 20 to forma a pouch there between. The pouch 80 can contain a stain treatment fluid 300. The pouch layer 70 can be heat sealed to the coating layer 50. The pouch layer 70 can be joined to the coating layer 50 using any known approach for attaching two materials including, but not limited to, adhesive, glue, ultrasonic bonding, chemical bonding, thermal bonding, and fusion bonding.

The pouch layer 70 can be a blown film or cast film. The pouch layer 70 can be liquid impervious and can be durable enough to prevent penetration or rupture of the pouch layer 70. The pouch layer 70 and coating layer 50 can also be chemically compatible with the stain treatment fluid 300 contained within the pouch 80. That is, the coating layer 50 and pouch layer 70 can be substantially inert to the stain treatment fluid 300 contained therein and the external environment for a duration sufficiently long to provide for chemical and mechanical stability from the time when the package is manufactured to the time when the package 10 is used to treat a stain. The pouch 80 can contain a volume of stain treatment fluid 300.

The pouch layer 70 can be a single layer or a laminate of multiple layers. The pouch layer 70 can comprise foil. The pouch layer 70 can be a layer of 12 μm thick sheet material, an adhesive layer, and a layer of 0.06 mm thick linear low density polyethylene. The pouch layer 70 can be white. The pouch layer 70 can be printed or otherwise labeled with a design, instruction on use, or decorative feature. The pouch layer 70 can be clear. The pouch layer 70 can be a layer of 12 μm thick metalized polyethylene terephthalate sheet material, an adhesive layer, and a layer of linear low density polyethylene. The pouch layer 70 can be a layer of 12 μm thick silver or aluminum foil, an adhesive, a 0.009 mm thick silver or aluminum foil, and a 0.05 mm linear low density polyethylene sheet material.

in one embodiment, the pouch layer 70 can be joined with the backing layer 20 to form a pouch 80 there between. The pouch layer 70 can be joined to the backing layer 20 by using any known approach for attaching two materials including, but not limited to, adhesive, glue, ultrasonic bonding, chemical bonding, thermal bonding, and fusion bonding.

Figure 2:
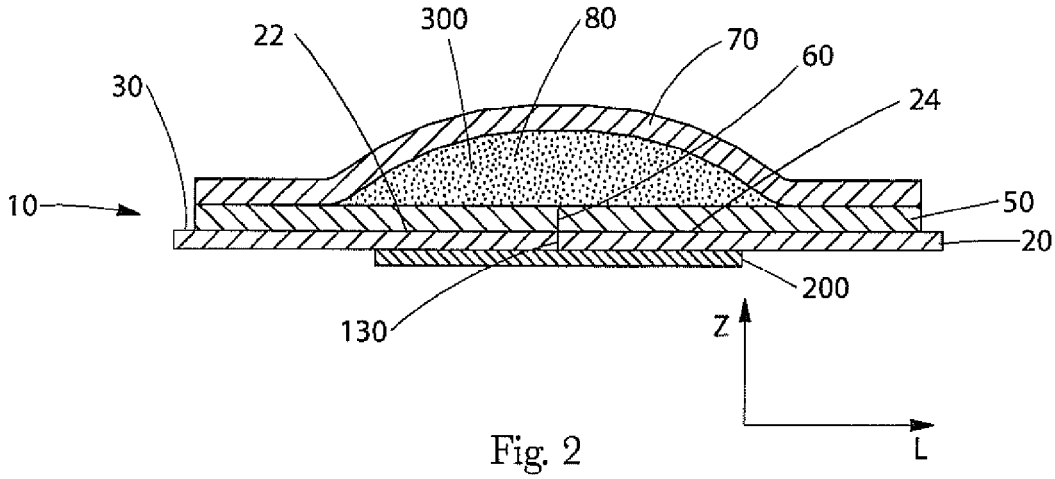
FIG. 2 is a schematic of a cross section view of the package for treating a stained fabric, as indicated in FIG. 1.

A cross section of the package 10 illustrated in FIG. 1 is shown in FIG. 2. As shown in FIG. 2, the second side 30 of backing layer 20 has a first planar region 22 and a second planar region 24 on opposing sides of the line of weakness 130. As shown in FIG. 2, the transmitting portion 60 can be substantially aligned with the line of weakness 130. When the backing layer 20 is broken, pouch 80 is in fluid communication with the contact substrate 200, the stain treatment fluid 300 flowing through the transmitting portion 60 and break in the backing layer 20 proximal the line of weakness 130 into the contact substrate 200. The coating layer 50 can be coextensive with the backing layer 20 or within the periphery of the backing layer 20. The coating layer 50 can be at least coextensive with the periphery of the backing layer 20.

Figure 3:
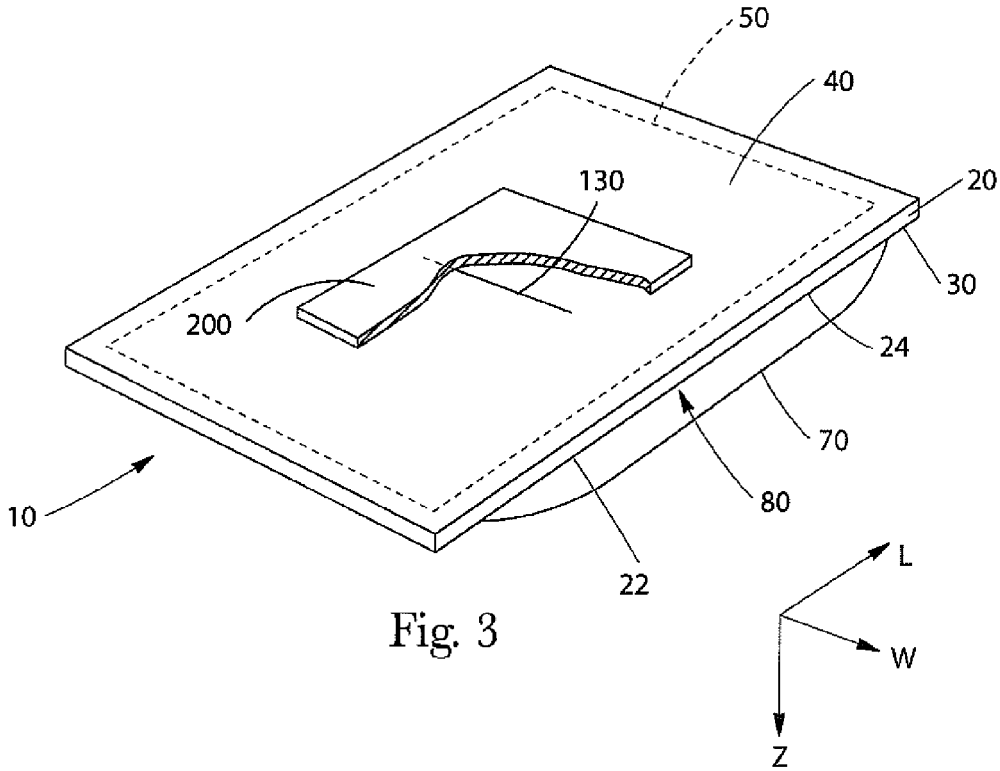
FIG. 3 is a schematic of a bottom perspective view of the package for treating a stained fabric illustrated in FIG. 1, first side 40 being presented to the viewer.

A bottom view of a package 10 is illustrated in FIG. 3. As shown in FIG. 3, the line of weakness 130 can be at least partially spatially aligned with the contact substrate 200 so that when the backing layer 20 is broken, stain treatment fluid 300 from within the pouch 80 can be transported through the break in the backing layer 20 into the contact substrate 200. As shown in FIG. 3, the line of weakness can partially extend between edges of the backing layer 20.

Figure 4:
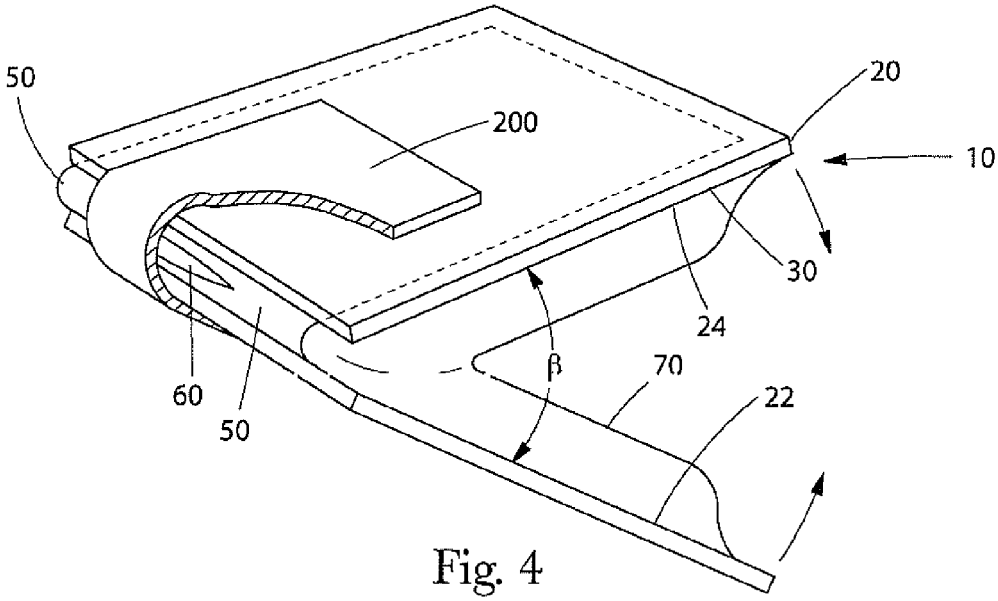
FIG. 4 is a schematic of a package for treating a stained fabric, the package being in the second position.

The package 10 can have a first position in which the first planar region 22 and second planar region 24 of the backing layer 20 are substantially in plane with one another. As shown in FIG. 4, the package 10 can be transitioned into a second position in which the first planar region 22 and second planar region 24 are in a substantially angularly facing relationship. By substantially angularly facing relationship it is meant that the first planar region 22 and the second planar region 24 are disposed with respect to one another at an interior angle β of less than about 90 degrees, the interior angle β being measured between the first planar region 22 and the second planar region 24 on the second side 30 of the backing layer 20.

In the first position, at least a portion of the first planar region 22 and the second planar region 24 can be integral with one another. The backing layer 20 can be at least partially intact across the line of weakness 130. In the second position at least a portion of the backing layer 20 can be discontinuous across the line of weakness 130. In the second position, the backing layer 20 can be broken at, proximal to, or along the line of weakness 130 so that the pouch 80 is in fluid communication with the contact substrate 200.

When the package 10 is in the first position, the package 10 can conveniently be carried in a pocket, a pocket of a wallet, pocket of a purse, or an auto glove compartment. The generally flat nature of the package 10 provides for a profile that is not bulky and can be stored conveniently.

As shown in FIG. 4, in the second position, the transmitting portion 60 can be fluid pervious. The transmitting portion 60 can be fluid pervious, for instance, as a result of a slit in the coating layer 50. As shown in FIG. 4, the transmitting portion 60 can be a slit that can be slightly stretched open. In the second position, the first planar region 22 and the second planar region 24 can be disposed at an interior angle β of less than about 45 degrees, measured between the first planer region 22 and the second planar region 24. The transmitting portion 60 can have a variety of embodiments that provide for fluid communication through the coating layer 50. In the second position, the first planar region 22 and the second planar region 24 can be disposed at an interior angle β of less than about 10 degrees, alternatively at an interior angle β of less than about 5 degrees, alternatively at an interior angle β of less than about 1 degree. In the second position, the first planar region 22 and the second planar region 24 can be disposed at an interior angle β between about zero degrees and about 5 degrees.

In the second position, the pouch 80 can be folded upon itself and pressure applied through the first planar region 22 and the second planar region 24 can extrude out the stain treatment fluid 300 contained within the pouch 80. As the first planar region 22 and second planar region 24 are brought in closer angular facing relationship, more of the stain treatment fluid 300 contained within the pouch 80 can be expressed or extruded. Once a significant squeezing force is applied by the user, the first planar region 22 and second planar region 24 can be pressed towards one another driving out stain treatment fluid 300 from the pouch 80, through the transmitting portion 60 and into the contact substrate 200. The backing layer 20 folded upon itself can provide for a convenient gripping structure for the user of the package 10 to grasp as she rubs the contact substrate 200, if present, back and forth across the stain on the fabric being treated.

In the second position, the gripping structure provided by the backing layer 20 folded upon itself can allow the consumer to effectively use the package 10 to treat a stain, without having her hand contact the stain treatment fluid 300 or contact substrate 200. Further, such gripping structure can provide for a sturdy structure that the consumer can rub back and forth vigorously, thereby rubbing the contact substrate 200 or edges of the broken backing layer 20, if a contact substrate is not present, against the stain.

The second elastic limit of the coating layer 50 can be greater than the first elastic limit of the backing layer 20. Such a design can provide for a mechanical arrangement in which when the coating layer 50 and backing layer 20 joined together are strained, the backing layer 20 can break before the coating layer 50. Such an arrangement can be desirable because once the backing layer 20 breaks, the coating layer 50 can provide for maintaining the structural integrity of the package 10 and the transmitting portion 60 of the coating layer 50 can be remain bounded by coating layer 50 such that stain treatment fluid 300 can be metered through the transmitting portion 60. The transmitting portion 60 can have a shape that provides for controlled fluid flow there through.

Figure 5:
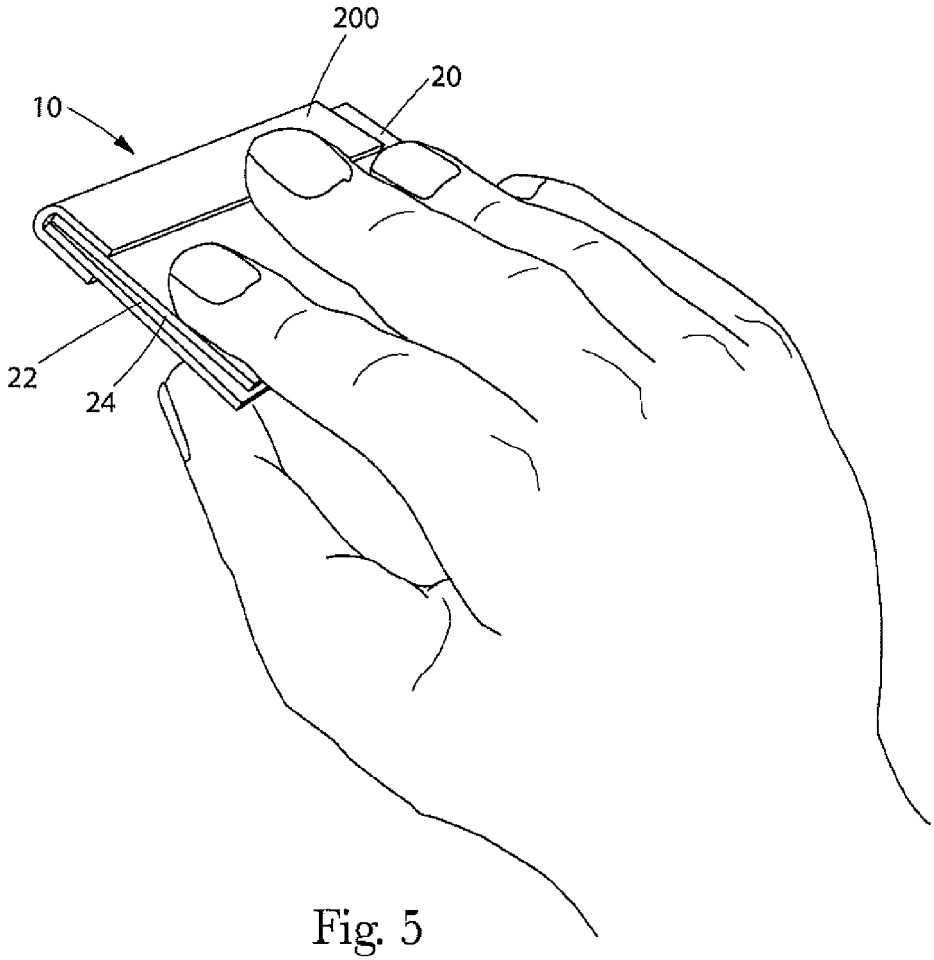
FIG. 5 is a schematic of a package for treating a stained fabric, the package being in the second position.

A stained fabric employing the package 10 can be treated by bending the backing layer 20 about the line of weakness 130 to move the first planar region 22 and the second planar region 24 into a substantially facing relationship, thereby making a portion of the backing layer to be discontinuous across the line of weakness 130. As the first planar region 22 and the second planar region 24 are pressed towards one another by the user, the stain treatment fluid 300 is dispensed to the contact substrate 200 through the portion of the backing layer 20 that is discontinuous across the line of weakness 130. The backing layer 20 is gripped, for instance in a manner similar to that shown in FIG. 5, and the user rubs the stained fabric with the contact substrate 200.

Figure 6:
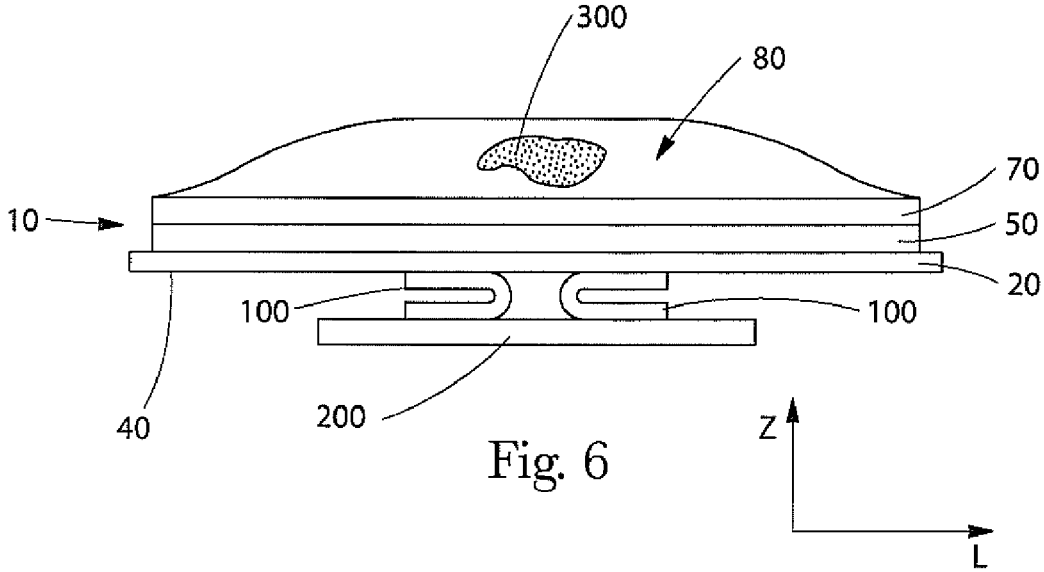
FIG. 6 is a schematic of a side view of a package for treating a stained fabric.

To allow more of the contact substrate 200 to contact the stained fabric, the contact substrate 200 can be joined to the backing layer 20 by one or more hinges 100, as shown in FIG. 6. By employing a hinged arrangement, the contact substrate can remain relatively flat even as the backing layer 20 is bent or folded about the line of weakness 130. Each hinge 100 can be formed from a flexible material that allows a variable distance to be defined between the backing layer 20 and the contact substrate 200. Each hinge 100 can be joined in part to the first side 40 and joined in part to the contact substrate 200. When the backing layer 20 is in a planar condition prior to being used to treat a stain, each hinge 100 can be closed, for example by a single bend or multiple folds in the relevant hinge 100. When each hinge 100 is closed, the contact substrate 200 can be in facing relationship with the backing layer 20, which can provide for a compact package 10. Each hinge 100 can be constructed from a piece of flexible material that is folded upon itself to have a nearly planar shape before the package is transitioned from the first position to the second position.

Figure 7:
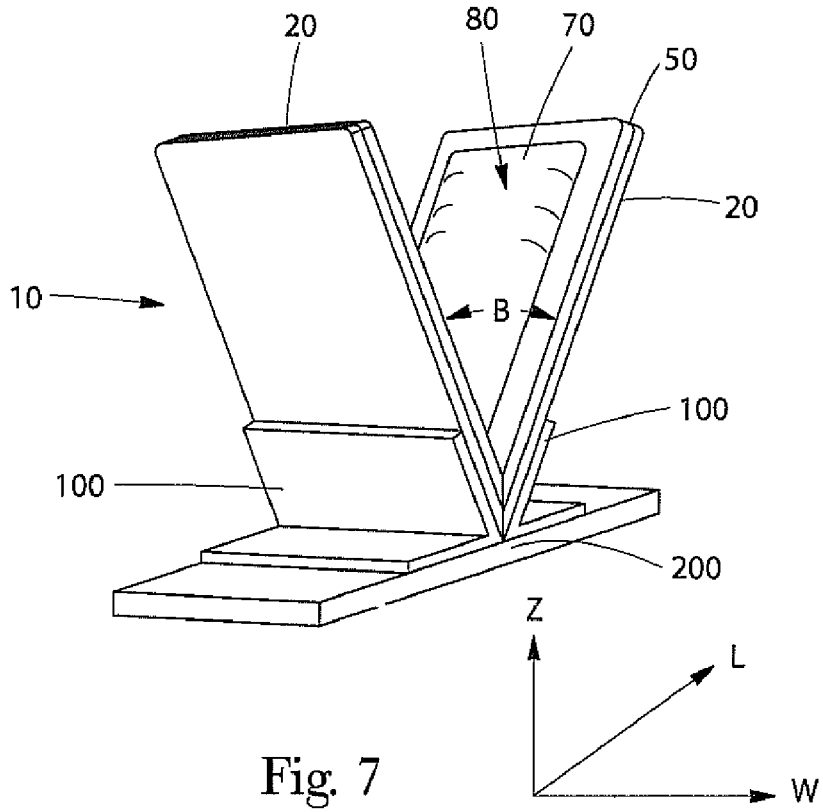
FIG. 7 is a package for treating a stained fabric, the package being illustrated in a second position.

When the backing layer 20 is broken and package 10 is transitioned from the first position to the second position by bringing the first planar region 22 and the second planar region 24 into a substantially angularly facing relationship, each hinge 100 can open to provide for a portion the contact substrate 200 to be spaced apart from the backing layer, as shown in FIG. 7. When the package is in the second position, each hinge 100 can have a generally "U" or "V" shape in cross-section, as shown in FIG. 7. Such an arrangement can provide for a conduit to direct stain treatment fluid 300 from the pouch 80 to the contact substrate 200 with limited accumulation of the stain treatment fluid 300 in other components of the package 10. Each hinge 100 can be considered to have two legs, one of which is joined to the backing layer 20 and one of which is joined to the contact substrate 200. The legs of each hinge 100 joined to the contact substrate 200 can be substantially coextensive with contact substrate 200 in that more than about 90% of the side of the contact substrate 200 facing the backing layer is joined to a hinge 100. A leg of each hinge 100 can be joined to the contact substrate 200 or the backing layer 20 using any known approach for attaching two materials including, but not limited to, adhesive, glue, ultrasonic bonding, thermal bonding, and fusion bonding. To provide for a more durable package 10, the approach for joining each hinge 100 can be chemically compatible with the stain treatment fluid 300. Each hinge 100 can be a polypropylene based tape such as 3M 3560, available from 3M.

Figure 8:
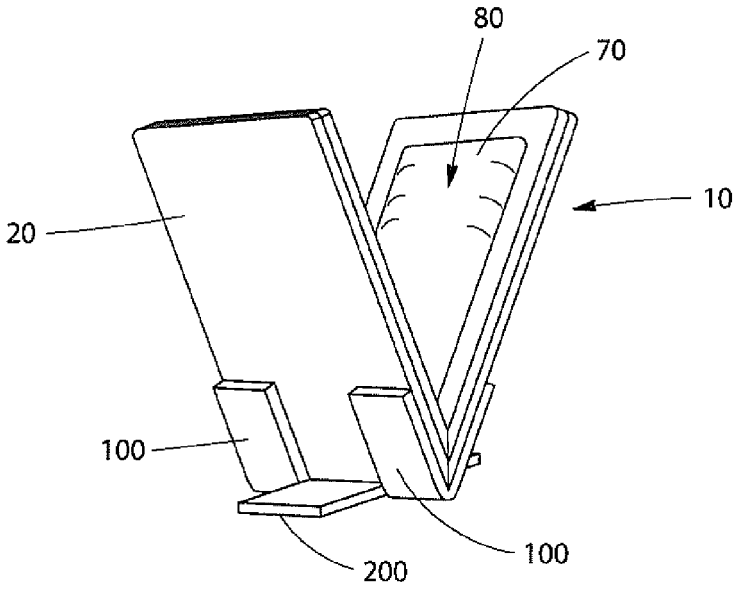
FIG. 8 is a package for treating a stained fabric, the package being illustrated in a second position.

Each hinge 100 can be an integral extension of the contact substrate 200 and comprise the same constitutive material as the contact substrate 200, as illustrated in FIG. 8. Such arrangement might provide for ease of manufacture by reducing the number parts that must be assembled to form the package 10.

Figure 9:
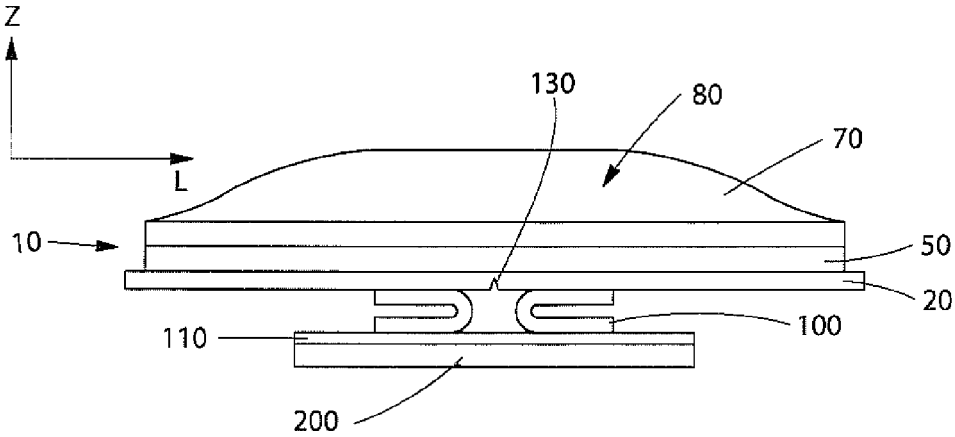
FIG. 9 is a schematic of a side view of a package for treating a stained fabric.

A foundation layer 110 can be joined to the contact substrate 200 and the backing layer 20, as shown in FIG. 9, such that the foundation layer 110 is between the contact substrate 200 and the backing layer 20 and the hinges 100, if present, are joined to the foundation layer 110. The foundation layer 110 can provide for enhanced structural stability of the package 10 when the contact substrate 200 is vigorously rubbed against a stained fabric. The foundation layer 110 can be, for example, a web of fluid permeable material, or material rendered to be selectively fluid permeable proximal the line of weakness 130, that is about coextensive with or laterally within the contact substrate 200 in the length direction L and width direction W. The foundation layer 110 can be a web of fluid permeable material that is coextensive with the contact substrate 200 in the length direction L and width direction W.

The foundation layer 110 can be joined to the backing layer 20 through each hinge 100 using any known approaches for joining two materials, including, but not limited to, adhesive, glue, ultrasonic bonding, thermal bonding, chemical bonding, and fusion bonding. Similarly, the foundation layer 110 can be directly joined to the contact substrate 200 using any known approaches for joining two materials, including, but not limited to, adhesive, glue, ultrasonic bonding, thermal bonding, chemical bonding, and fusion bonding. The foundation layer 110 can be joined to the contact substrate 200 through one or more intermediate layers. The foundation layer 110 can be a web of material selected from the group consisting of a porous film, a slit film, an apertured film, a nonwoven, a woven, and combinations thereof. The foundation layer 110 can be a polyethylene based material such as DELNET AC 530-NAT-E, high density polyethylene based substrate, having a basis weight of 18 g/m$^2$, and 0.12 mm thick, available from DelStar Technologies, Inc.

Figure 10:
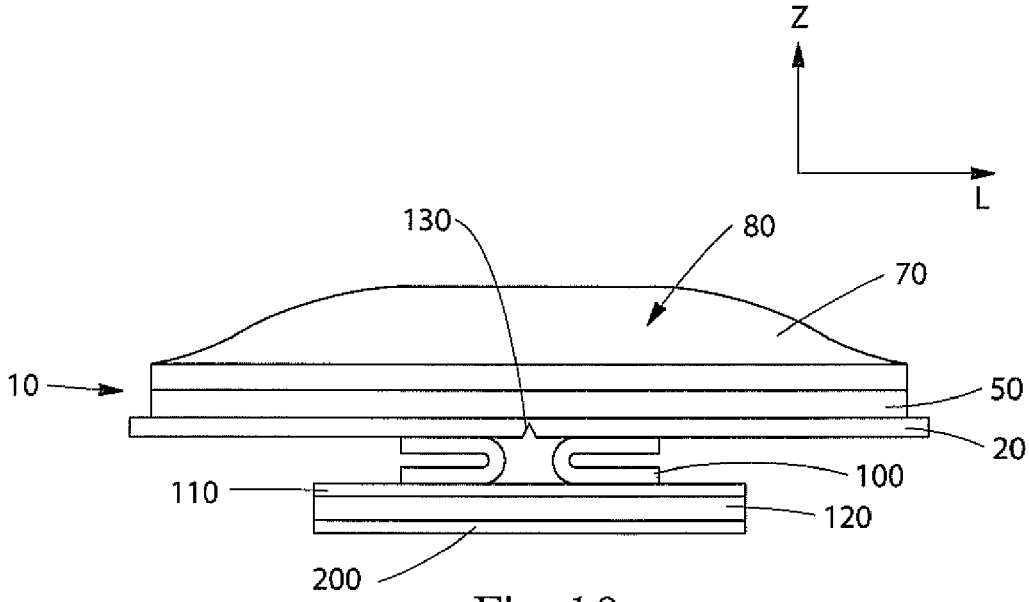
FIG. 10 is a schematic of a side view of a package for treating a stained fabric.

In some embodiments, a distribution layer 120 can be disposed in facing relationship with the contact substrate 200 and between the backing layer 20 and the contact substrate 200, for example, as shown in FIG. 10. The distribution layer 120 can provide for extensive distribution in the length direction L and width direction W of the stain treatment fluid 300 into and/or through the contact substrate 200. To promote delivery of the stain treatment fluid 300 to the fabric being treated, the distribution layer 120 can have a free absorbent capacity that is less than the volume of stain treatment fluid 300 contained in the pouch 80. The distribution layer 120 can comprise a hydrocarbon based fibrous material. The distribution layer 120 can comprise a fibrous material selected from the group consisting of polyethylene, polypropylene, nylon, polyethylene terephthalate, rayon, and combinations thereof. The distribution layer 120 can be joined to the contact substrate 200, for instance by any known approaches for attaching two materials, including, but not limited to, adhesive, glue, ultrasonic bonding, thermal bonding, chemical bonding, and fusion bonding. The distribution layer 120 can be a needle punched fibrous material. The distribution layer 120 can be a polypropylene needle punched nonwoven having a basis weight of 150 g/m$^2$. The basis weight can be determined following EDANA Standard Test: WSP 130.1 (05), Standard Test Method for Mass per Unit Area, on a 1 cm×1 cm sample and using a balance accurate to 0.0001 g. The basis weight is determined based upon 5 samples combined and calculating an average from the combined weight/area. The distribution layer 120 and foundation layer 110 can be a composite material. STRATEX 5.0NP5-E, a composite substrate made by DelStar Technologies, Inc., can provide for a single product that includes both the distribution layer 120 and foundation layer 110. This distribution layer 120 can be 1.5 mm thick. The thickness of the distribution layer can be determined following EDANA Recommended Test Method: Nonwovens Thickness (30.5-99).

The free absorbent capacity of the distribution layer 120 is measured as follows. The apparatus required includes a stainless steel test sieve of 2 mm nominal mesh size according to ISO 565, that is about 120 mm×120 mm and a dish for containing the wire gauze with the test sample. The dish must be of sufficient volume to allow a test liquid depth of 20 mm. The test liquid is 10% Sodium Dodecyl Sulfate solution in distilled water. A suitable weighing glass and cover are used. A balance having an accuracy of plus or minus 0.01 g and a stop watch are also needed.

The test is conducted in a laboratory with an ambient temperature of 25.0±0.2° C. and relative humidity 50±5%. All apparatus and samples are equilibrated in the testing environment for two hours. The test dish is covered to prevent excessive evaporation. A representative rectilinear sample of the distribution layer 120 with a weight of 1.00±0.05 grams is cut from the distribution layer material taking care not to compress or otherwise perturb the structure. The length divided by the width of the sample must be less than 2, with the length being the longer side of the sample. If an individual distribution layer 120 is not of sufficient dimensions to prepare such test pieces, more than one distribution layer 120 from more than one package 10 can be combined to provide a stack of rectilinear test pieces with the required weight and aspect ratio. Each test piece, or stack of pieces, is weighed on a balance having an accuracy of 0.01 g. A test piece (or stack) is placed on the wire gauze and is fastened thereto by a suitable clip along the width edge (i.e. within 1 mm of the edge of the material along the shorter dimension in the plane of the material). The wire mesh and attached sample are introduced to the test liquid at an oblique angle with the sample facing upwards. Once submerged, the gauze is placed horizontally 20 mm below the surface of the test liquid. This is conveniently achieved if the dish has a flat bottom and the test fluid is 20 mm deep. After sixty seconds, plus or minus one second, the gauze and test piece (or stack) are removed from the test liquid and hung freely to drain for one hundred and twenty seconds, plus or minus three seconds. The sample is oriented so that the clip is at the top horizontal edge of the sample during the draining step. After draining, the test piece (or stack) is separated from the gauze without squeezing fluid from the test piece or stack. The mass of test piece (or stack) is then determined to within ±0.1 gram. The difference between the mass of the test piece or stack prior to wetting, and the mass of the test piece or stack after wetting is the free absorbent capacity of the material in grams of fluid absorbed per gram of material. This is converted to volume of fluid absorbed per gram of material by using 1 g/cm$^3$ as the test liquid density. The free absorbent capacity is taken to be the mean of five measurements made following this procedure. Freshly conditioned test liquid is used for each set of five measurements.

Figure 11:
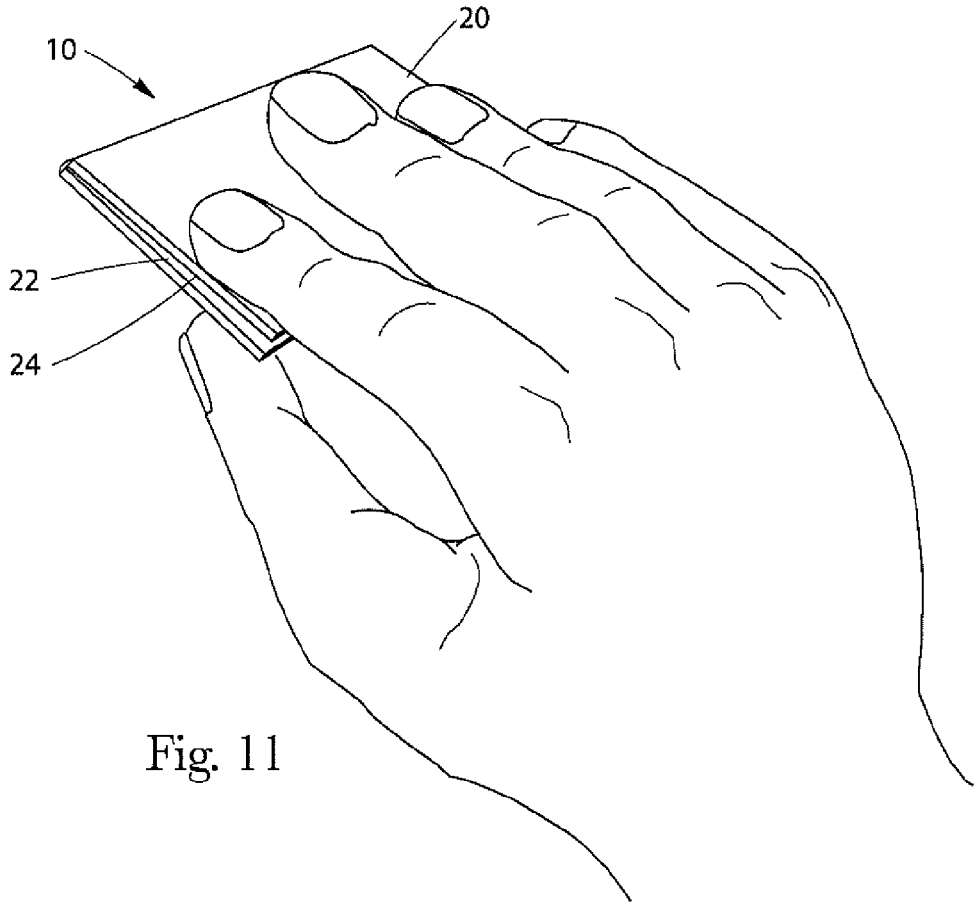
FIG. 11 is an embodiment of the package in which the package is devoid of a contact substrate.

Embodiments of the package 10 in which the package 10 is devoid of a contact substrate 200, as shown in FIG. 11, are also contemplated. When the package 10 is positioned in the second position by breaking the backing layer 20 along the line of weakness 130, stain treatment fluid 300 can flow through the discontinuity created in the backing layer 20. In other words, in the second position, the pouch 80 can be in fluid communication with the first side 40 of the backing layer. In the second position, the stain treatment fluid 300 can be expelled through the portion of the backing layer 20 that is discontinuous across the line of weakness 130. In such an embodiment, the stain treatment fluid 300 could be a gel to provide for improved control of application of the stain treatment fluid 300. As or after the fluid is applied to the fabric being treated, the broken edge of the backing layer 20 can be scraped back and forth against the fabric being treated, thereby applying and distributing the stain treatment fluid 300 to the stain and potentially dislodging agglomerations/globules of the stain, bleaching the stain, and/or brightening the fabric.

A stained fabric can be treated by employing the package 10 illustrated in FIG. 11 by bending the backing layer 20 about the line of weakness 130 to move the first planar region 22 and the second planar region 24 into a substantially facing relationship, thereby making a portion of the backing layer to be discontinuous across the line of weakness 130. As the first planar region 22 and the second planar region 24 are pressed towards one another by the user, the stain treatment fluid 300 is dispensed to the first side 40 of the hacking layer 20 through the portion of the backing layer 20 that is discontinuous across the line of weakness 130. The backing layer 20 is gripped, for instance in a manner similar to that shown in FIG. 5, and the user rubs the stained fabric with the portion of the backing layer 20 that is discontinuous across the line of weakness 130.

Figure 12:
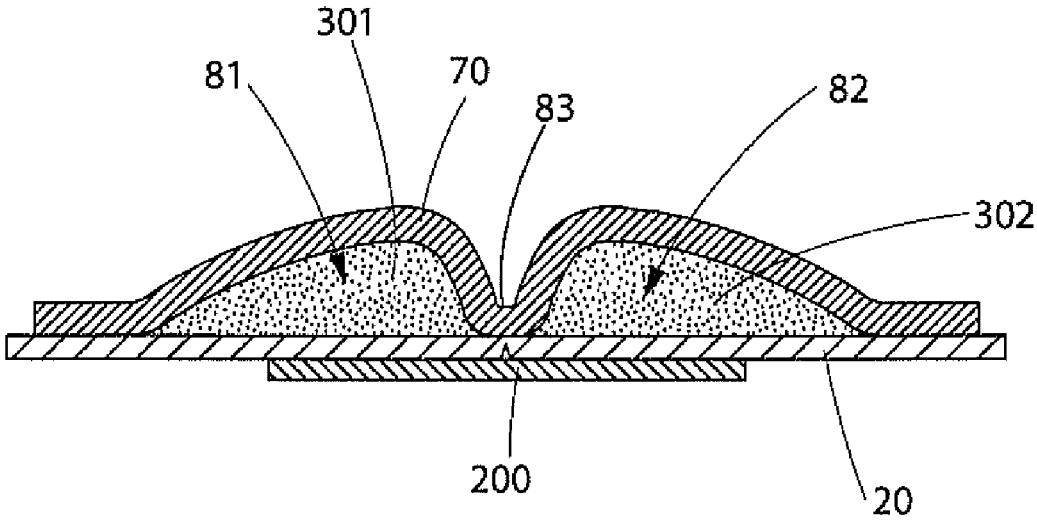
FIG. 12 is a cutaway perspective of an alternate embodiment of the package that provides for a package that can dispense a first stain treatment fluid and a second stain treatment fluid.

FIG. 12 is a cutaway perspective of an alternate embodiment of the package 10 that provides for a package that can dispense a first stain treatment fluid 301 and a second stain treatment fluid 302. This arrangement might be practical in that two materials that interact favorably or provide for treatment efficacy for different types of stains can be dispensed. For instance, the first stain treatment fluid 301 might provide for effective treatment of hydrophobic grease stains and the second stain treatment fluid 302 might provide for effective treatment of hydrophilic wine stains, for instance by bleaching. The first stain treatment fluid 301 might be a detergent and the second stain treatment fluid 302 might be a bleach compound. Such an arrangement might be beneficial for stain treatment fluid components are not stable or lose efficacy when stored together for prolong periods of time. Such an arrangement might be beneficial for stain treatment fluid components that have optimum efficacy under different local conditions (e.g. pH). The pouch layer 70 can be joined with the backing layer 20, or to the coating layer 50 if present, thereby forming a first pouch 81 and a second pouch 82. The first pouch 81 and the second pouch 82 can be separated by a separating portion 83. The separating portion 83 can be generally aligned parallel with the line of weakness 130, generally orthogonal to the line of weakness 130, or otherwise generally aligned with the line of weakness 130. The first pouch 81 can contain the first stain treatment fluid 301 and the second pouch 82 can contain the second stain treatment composition 302. A portion of the separating portion 83 can intersect a portion of the line of weakness 130.

Figure 13:
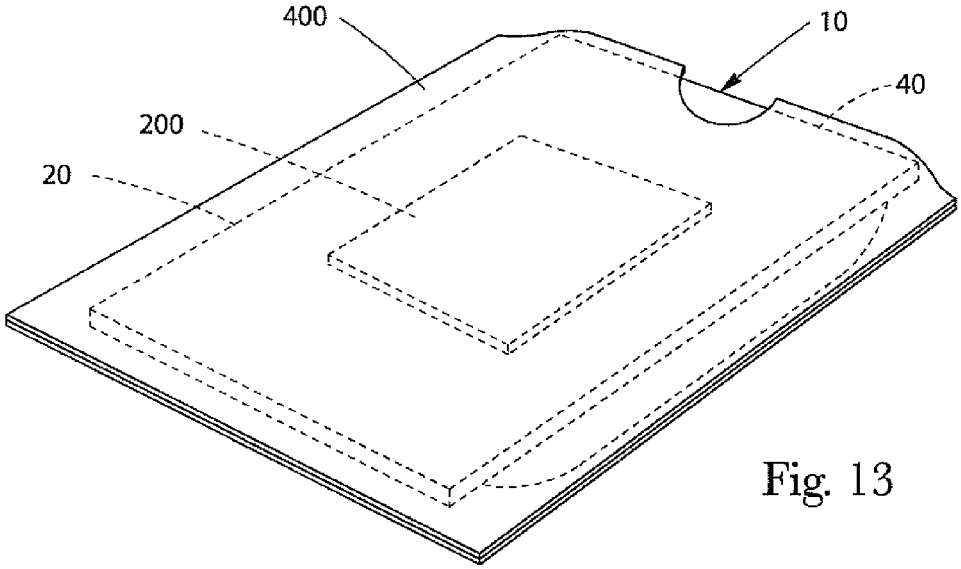
FIG. 13 is a schematic of a package covered by a removable protectant.
Figure 14:
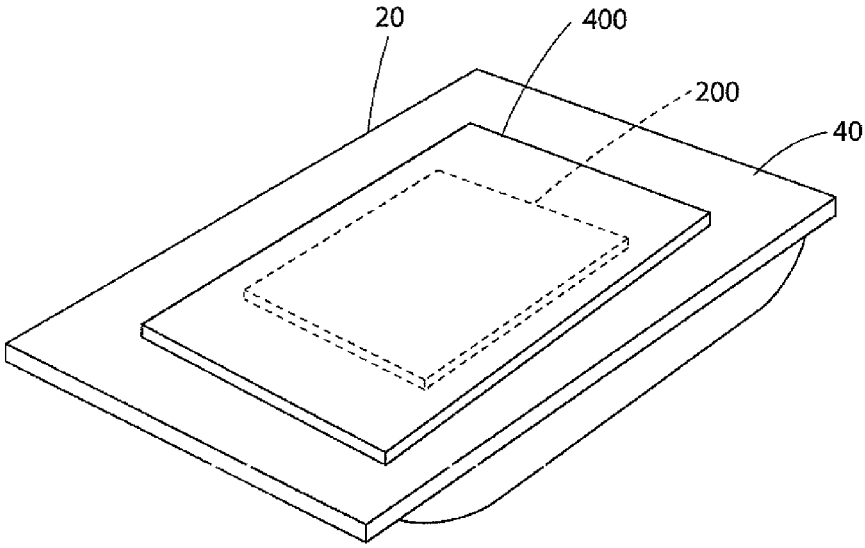
FIG. 14 is a schematic of another embodiment of a package covered by a removable protectant.

The package 10 can be covered by a removable protectant 400, for instance as shown in FIGS. 13 and 14. The first side 40 of backing layer 20 can be at least partially covered by a removable protectant 400. The removable protectant 400 can be selected from the group consisting of a wrap wrapped around the backing layer 20 and substantially covering the contact substrate 200, a slip liner at least partially enclosing the package 10, an envelope enclosing the package 10, a sealed packet enclosing the package 10, and a release strip releaseably joined to the backing layer 20. The contact substrate 200 is considered to be substantially covered when more than about 75% of the surface of the contact substrate 200 oriented away from the first side 40 of the backing layer 20 is covered. The protectant 400 can be comprised of, for example, film, paper, fibrous nonwoven, foil, or any other suitably durable material that can withstand the wear and tear that might occur to such protectant 400 containing the package 10 prior to use. The protectant 400 might limit damage to the package 10 due to the package 10 being carried in a wallet, purse, pocket, diaper bag, auto glove compartment, or other such location that package 10 might be in prior to use. The protectant 400 might be releasably joined to the first side 40 of the backing layer 20 by an adhesive. The protectant 400 might be releasably joined to the backing layer 20 using any known approach for attaching two materials including, but not limited to, adhesive, glue, ultrasonic bonding, chemical bonding, thermal bonding, and fusion bonding.

The package 10 can be a dispensing package such as that disclosed in U.S. Pat. No. 7,506,762 B2. The package 10 can be a dispensing package such as that disclosed in U.S. Patent Pub. No. 2009/0074502 A1.

In one embodiment, the contact substrate 200 can be a polypropylene/polyethylene 70/30 hollow 16 segmented pie microfiber from ES Fibervisions/Chisso, referred to as code 020 having a fiber diameter of 2.2 denier, fiber length of 51 mm, and a basis weight of 60 g/m$^2$. In one embodiment, the contact substrate can be selected from the group consisting of a foam, a fibrous material, a film, a brush, and combinations thereof. Without being bound by theory, it is thought that a contact substrate 200 that presents a rough surface to the fabric being treated can improve stain treatment because the rough surface can aid with dislodging the stain from the fabric.

A contact substrate 200 comprising micro fibers can provide for effective stain removal. Without being bound by theory, it is thought that the micro fibers provide for smaller interstitial spaces between the fibers making up the contact substrate, such smaller spaces being able to hold greasy materials more effectively than a contact substrate 200 consisting of larger fibers. In one embodiment, the contact substrate 200 can comprise micro fibers having a diameter between about 0.1 micrometers and about 5 micrometers. In one embodiment, the contact substrate 200 can comprise microfibers having a diameter less than about 5 micrometers. The micro fibers can be notched-pie micro fibers, which have sharp fiber edges that are generated during formation of such micro fibers. The micro fibers can be staple fibers or continuous splitted fibers. The micro fibers can be split polypropylene-polyethylene micro fibers.

The contact substrate 200 can be selected from the group consisting of polyethylene, polypropylene, nylon, polyethylene terephthalate, rayon, and combinations thereof. Such fiber types are thought to possibly provide for stain lifting due to their molecular makeup. The contact substrate can be selected from the group consisting of a nonwoven comprising microfibers, a woven comprising microfibers, a looped woven comprising microfibers, and combinations thereof, with micro fibers being practical as discussed above.

The composition of stain treatment fluid 300 may be one known in the art for stain treatment such as compositions containing a chelating agent, radical scavenger and preferably a bleach disclosed in U.S. Pat. No. 6,846,332.

The composition of stain treatment fluid 300 can be aqueous or non-aqueous. In one embodiment the composition comprises from 0% to about 99.99%, alternatively from about 70% to about 99.99%, alternatively from about 90% to about 99.9%, alternatively from about 94.0% to about 99.0%, by weight, of water and therefore be aqueous solutions.

The composition of stain treatment fluid 300 can comprise additional components such as bleach, surfactant, solvent, chelating agents, radical scavengers, and mixtures thereof.

The contact substrate 200 can have at least one side that is light colored. A light colored contact substrate 200 can function as an indicator that the stain being treated is being effectively lifted from the fabric being treated and being transferred to the contact substrate 200. As the contact substrate 200 acquires the stain, the color of the contact substrate may tend to darken. For stains on patterned fabrics, which may be hard to see in low lighting situations, such as a restaurant, where stains are likely to occur, having a light colored contact substrate 200 that darkens when used can help the user of the contact substrate monitor that the stain is being removed.

A contact substrate 200 can have a L* value greater than about 80. A contact substrate 200 can have an L* value greater than about 85. A contact substrate 200 can have an L* value greater than about 90. A contact substrate 200 can have an L* value greater than about 95. A contact substrate 200 can have an L* value of greater than about 90 and an a* value between about −5 and about 5 and a b* value between about −5 and about 5.

The color of a contact substrate 200 is measured by the reflectance spectrophotometer according to the colors L*, a*, and b* values. If the contact substrate 200 is joined to a backing layer 20, the L*, a*, and b* values of the contact substrate 200 are measured on the side of the contact substrate 200 that is oriented away from the backing layer 20.

Reflectance color is measured using a Hunter Reflectance Meter test that employs using the Hunter Lab LabScan XE reflectance spectrophotometer obtained from Hunter Associates Laboratory of Reston, Va. A contact substrate 200 is tested at an ambient temperature between 65° F. and 75° F. and a relative humidity between 50% and 80%.

The spectrophotometer is set to the CIELab color scale and with a D65 illumination. The Observer is set at 10° and the Mode is set at 45/0°. Area View is set to 0.125" and Port Size is set to 0.20". The spectrophotometer is calibrated prior to sample analysis utilizing the black glass and white reference tiles supplied from the vendor with the instrument. Calibration is done according to the manufacturer's instructions as set forth in LabScan XE User's Manual, Manual Version 1.1, August 2001, A60-1010-862. If cleaning is required of the reference tiles or samples, only tissues that do not contain embossing, lotion, or brighteners should be used (e.g., PUFFS tissue). Any sample point on the contact substrate 200 facing away from the first side 40 of the backing layer 20 can be selected.

Figure 15:
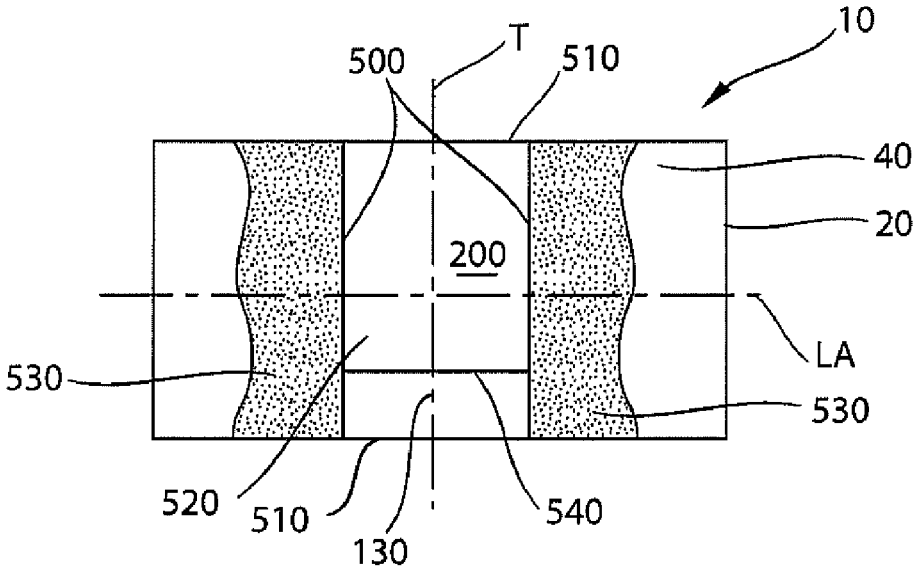
FIG. 15 is a schematic of another embodiment of a package having a first color and a second color.

To improve the ability for the user to identify the appropriate portion of the package 10 to use for treating a stain, the contact substrate 200 can have a first color 520 and the first side 40 of the backing layer 20 can have a second color 530, as shown in FIG. 15. The package 10 can be considered to have a longitudinal axis LA and a transverse axis T, the transverse axis T is orthogonal to and intersecting the longitudinal axis LA, The longitudinal axis LA is generally aligned directionally with the length direction L.

The first color 520 and second color 530 are measured by a Hunter Reflectance Meter Test according to the colors L*, a*, and b* with L*, a*, and b* being measured on a surface of the contact substrate 200 oriented away from the first side 40 of the backing layer 20.

The first color 520 and the second color 530 can have a difference in color calculated using L*, a*, and b* values by the formula $\Delta E=[(L^*_X-L^*_Y)^2+(a^*_X-a^*_Y)^2+(b^*_X-b^*_Y)^2]^{1/2}$, wherein the ΔE between the first color 520 and the second color 530 is greater than about 10. Herein, the 'X' in the equation can represent the contact substrate 200 or the first side 40 of the backing layer 20. 'Y' in the equation can represent the contact substrate 200 or the first side 40 of the backing layer 20. 'X' and 'Y' are not to be the same object. In other words, for any particular evaluation of the difference in color, the location of 'X' is not the same as the location of 'Y'.

A difference in color of ΔE greater than about 10 provides a difference in color that can appear distinct to an observer. The greater the ΔE between the first color 520 and second color 530, the more readily distinguishable the two colors are. The ΔE between the first color 520 and second color 530 can be greater than about 20. The ΔE between the first color 520 and second color 530 can be greater than about 30. The ΔE between the first color 520 and second color 530 can be greater than about 40. The ΔE between the first color 520 and second color 530 can be greater than about 50. The ΔE between the first color 520 and second color 530 can be greater than about 55. The ΔE between the first color 520 and second color 530 can be greater than about 60. The ΔE between the first color 520 and second color 530 can be greater than about 65. The ΔE between the first color 520 and second color 530 can be greater than about 70. The ΔE between the first color 520 and second color 530 can be greater than about 80. The ΔE between the first color 520 and second color 530 can be greater than about 90. The difference in color ΔE between the first color 520 and second color 530 can be greater than any integer number greater than 10.

By having a ΔE between the first color 520 and the second color 530, the contact substrate 200 visually stands out from the first side 40 of backing layer 20 so that the user can easily recognize the location of the substrate. One could contemplate an embodiment that may look sanitary by having the both the backing layer 20 and the contact substrate 200 be a brilliant white, which might be desirable given that the package 10 is designed to treat stains on fabric. In such an embodiment, the user might not be able to quickly identify where the contact substrate 200 for scrubbing the stain is on the package 10. Further, in a retail environment, if such a package 10 is presented to the consumer, it may challenging for the consumer to recognize the existence of the contact substrate 200 and how the package 10 is designed to function, particularly when viewed at a distance of 1 m or more from the package 10.

As shown in FIG. 15, the contact substrate can extend between a pair of opposing widthwise edges 500 on opposite sides of the line of weakness 130. For a rectangular contact substrate 200, the widthwise edges 500 can be substantially parallel to the transverse axis T. The contact substrate can have a pair of opposing lengthwise edges 510. The periphery of the contact substrate 200 can be bound by the pair of widthwise edges 500 and pair of lengthwise edges 510.

To enhance the visibility of the contact substrate 200, more than about 25% of each of the widthwise edges 500 can abut a portion of the backing layer 20 having the second color 530 when the package 10 is in the first position. The first position is when the first planar region 22 and second planar region 24 of the backing layer 20 are substantially in plane with one another, which is the situation for the package 10 prior to use. By having an appreciable fraction of each of the widthwise edges 500 abutting a portion of the backing layer 20 having the second color 530, a perceptible visual contrast can be present between the contact substrate 200 having the first color 520 and the first side 40 of the backing layer 20. To provide for even more enhanced visibility more than about 50%, more than about 75%, more than about 90, or about 100% of each of the widthwise edges 500 can abut a portion of the backing layer 20 having the second color 530 when the package 10 is in the first position.

In one embodiment, it can be practical for the first color 520 to have a L* value greater than about 80. Such a first color 520 for contact substrate 200 may be sufficiently light colored such that a greasy stain that is lifted from the fabric being treated may be visible on the contact substrate 200, thereby providing a visual cue to the user that the effort to treat the stain was successful. The first color 520 of the contact substrate 200 can have a L* value greater than about 80 and an a* value between about −5 and about 5 and a b* value between about −5 and about 5. The first color 520 of the contact substrate 200 can have a L* value greater than about 50, which for some types of stains may be light enough for a stain lifted from a fabric to be visually apparent on the contact substrate 200. The first color 520 can be white. The color white is defined as a color having an L* value of greater than about 80, an a* value equal to 0±2, and a b* value equal to 0±2. The entire contact substrate 200 can have a generally uniform color that is white.

The second color 530 of backing layer 20 can have a L* value less than about 80. The second color 530 of backing layer 20 can have a L* value less than about 60. Such L* values less than about 80 or less than about 60 may tend to be perceived as relatively dark, as compared to the first color 520 of the contact substrate 200 if the first color 520 is relatively light. The second color 530 of the backing layer can be orange. The color orange is defined as a color having an L* value of about 54, plus or minus 10, an a* value of about 61, plus or minus 10, and a b* value of about 70, plus or minus 10.

The greater the distance away from the boundary between the contact substrate 200 and the backing layer 20 that the second color 530 extends, the more distinctive the contact substrate 200 may appear, particularly when viewed from a distance of 1 m or more. The second color 530 may be a line, solid, dashed, dotted, or any pattern that abuts the widthwise edge 500 of contact substrate 200. The second color may extend beyond the widthwise edge 500 by more than about 10% of the length dimension 540 of the contact substrate 200 at the location along the widthwise edge 500 that abuts the second color 530. The contact substrate 200 can be considered to have a length dimension 540 that extends between the widthwise edges 500 and is orthogonal to the transverse axis T, transverse axis T being oriented in the same general direction as the line of weakness 130. For instance if the contact substrate 200 has a length dimension 540 of about 10 mm, the second color may extend beyond the widthwise edge 500 by more than about 1 mm. The second color 530 can extend beyond the widthwise edge by more than about 2 mm.

To provide for enhanced visual distinction for the contact substrate 200, the second color 530 can extend beyond the widthwise edge 500 by more than about 20%, of the length dimension 540 of the contact substrate 200 at the location along the widthwise edge 500. The second color 530 can extend beyond the widthwise edge 500 by more than about 30%, of the length dimension 540 of the contact substrate 200 at the location along the widthwise edge 500. The second color 530 can extend beyond the widthwise edge 500 by more than about 40%, of the length dimension 540 of the contact substrate 200 at the location along the widthwise edge 500. The entire first side 40 of backing layer 20 can be of the second color 530.

The contact substrate 200 can be provided with the first color 520 by inkjet printing, printing, gravure printing, flexographic printing, lithographic printing, and screen printing. The contact substrate 200 can be provided with the first color 520 by using pigments and/or dyes. For instance, if the contact substrate 200 is a fibrous material, the fibers may contain a whitening agent, for example titanium dioxide, that is included in the fibrous material at the time of manufacture of the constituent fibers. The first side 40 of backing layer 20 can be provided with the second color by inkjet printing, printing, gravure printing, flexographic printing, lithographic printing, and screen printing. The first side 40 of backing layer 20 can be provided with the second color 530 adhering another layer material having the second color 530 onto the first side 40 of backing layer 20. The backing layer 20 can contain a dye or pigment to impart the second color 530 to the backing layer.

Color measurements were performed on six SALLY HANSEN INSTA-SMOOTH PODS Creme hair remover for face packages (available from Coty US LLC, Dist., New York, N.Y. 10016) using the Hunter Reflectance Meter test. For the six packages evaluated, the average ΔE between the color of the contact substrate mounted on the hair remover package and the portion of the backing layer abutting the contact substrate, which was free from printing, was 7.04. For the contact substrate on the six packages evaluated, the average L* value was 86.10, the average a* value was −0.43, and the average b* value was 0.05. For a portion of the backing layer abutting the contact substrate that was free from printing, the average L* value was 93.03, the average a* value was −1.14, and the average b* value was −0.92.

Figure 16:
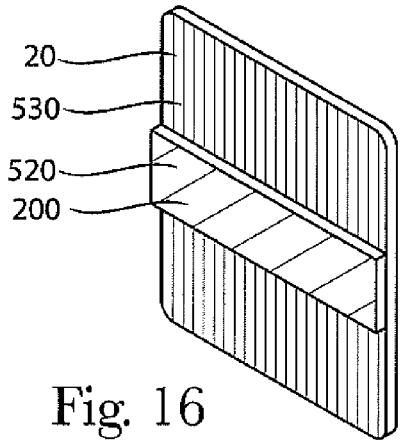
FIG. 16 is a perspective view of an embodiment of the package the difference in cross-hatching of each part of the package indicating different colors of each part of the package.
Figure 17:
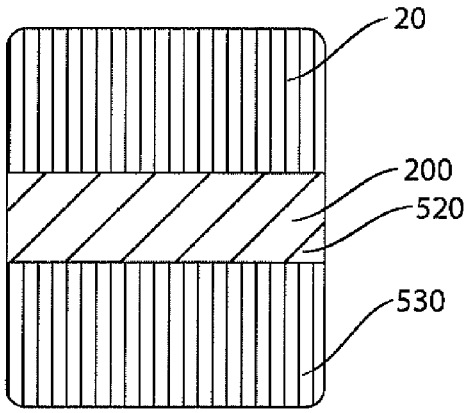
FIG. 17 is a front view the package of FIG. 16.
Figure 18:
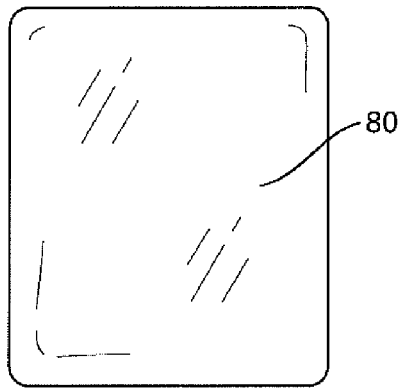
FIG. 18 is a rear view of the package of FIG. 16.
Figure 19:
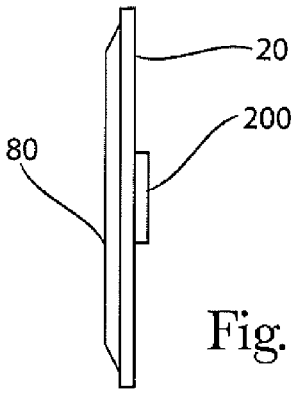
FIG. 19 is side view of the package of FIG. 16.
Figure 20:
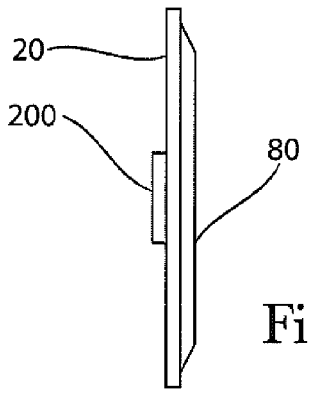
FIG. 20 is a side view of the package of FIG. 16, opposite the side view shown in FIG. 19.
Figure 21:
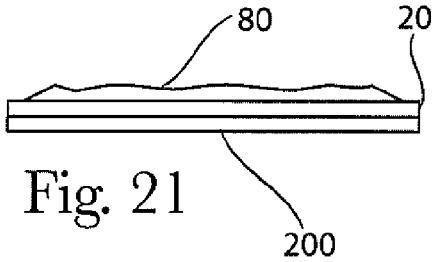
FIG. 21 is a top view of the package of FIG. 16.
Figure 22:
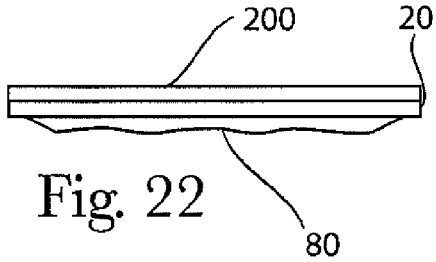
FIG. 22 is a bottom view of the package of FIG. 16.
Figure 23:
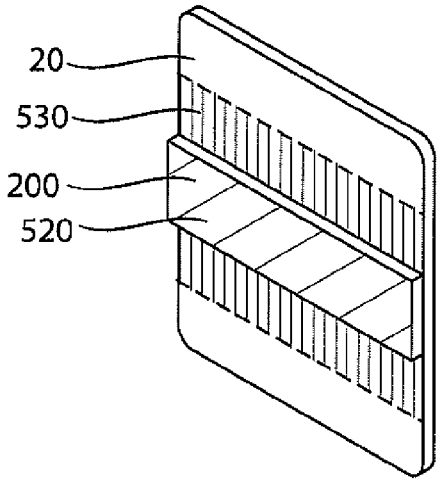
FIG. 23 is a perspective view of an alternative embodiment of the package, the difference in cross-hatching of each part of the package indicating different colors of each part of the package, the side views being the same as FIGS. 19 and 20, the top view being the same as FIG. 21, and the bottom view being the same as FIG. 22.
Figure 24:
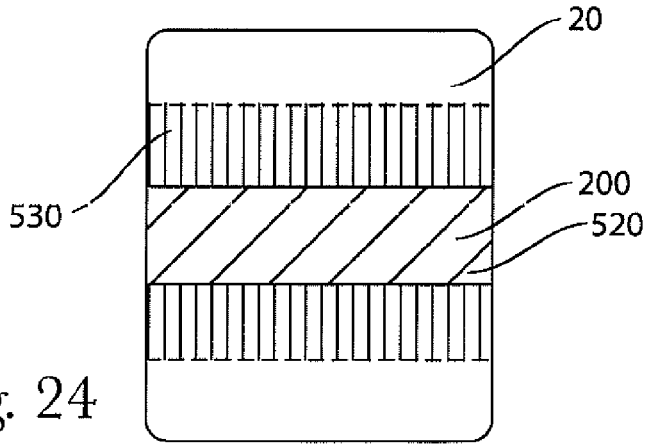
FIG. 24 is a front view of the package of FIG. 23.

FIG. 16 is a perspective view of an embodiment of the package the difference in cross-hatching of each part of the package indicating different colors of each part of the package. FIG. 17 is a front view the package of FIG. 16. FIG. 18 is a rear view of the package of FIG. 16. FIG. 19 is side view of the package of FIG. 16. FIG. 20 is a side view of the package of FIG. 16, opposite the side view shown in FIG. 19. FIG. 21 is a top view of the package of FIG. 16. FIG. 22 is a bottom view of the package of FIG. 16. FIG. 23 is a perspective view of an alternative embodiment of the package, the difference in cross-hatching of each part of the package indicating different colors of each part of the package, the side views being the same as FIGS. 19 and 20, the top view being the same as FIG. 21, and the bottom view being the same as FIG. 22. FIG. 24 is a front view of the package of FIG. 23. The dashed lines in FIGS. 23 and 24 are phantom lines.

The package 10, as described herein, can be used in a method for treating a stained fabric. The steps of the method can include bending the backing layer 20 about the line of weakness 130 to move the first planar region 22 and the second planar region 24 into a substantially facing relationship, thereby making a portion of the backing layer 20 to be discontinuous across the line of weakness 130. The stain treatment fluid 300 can be dispensed to the first side 40 of the backing layer 20 through the portion of the backing layer 20 that is discontinuous across the line of weakness 130. The backing layer can then gripped by the user and the stained fabric is rubbed with the portion of the backing layer 20 that is discontinuous across the line of weakness 130. If a contact substrate 200 is part of the package 10, the stain treatment fluid 300 is dispensed to the fluid pervious contact substrate 200 joined to the first side 40 of the backing layer 20 proximal the line of weakness 130, as part of the method. If a distribution layer 120 is present, the stain treatment fluid 300 can be transported through the distribution layer 120 to the contact substrate 200.

The method can be performed on a garment while the user of the package 10 is wearing the garment. The stained fabric can be a fibrous woven or nonwoven web. For example, the stained fabric can be part of a garment. In one embodiment, the method can be employed to treat a grease or oil stain on a fabric.

All percentages and ratios used herein are by weight of the total composition and all measurements made are at 25° C., unless otherwise designated. An angular degree is a planar unit of angular measure equal in magnitude to 1/360 of a complete revolution.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

All documents cited are, in relevant part, incorporated herein by reference; the citation of any document is not to be construed as an admission that it is prior art with respect to the present invention.

What is claimed is:

1. A package for treating a stained fabric, said package comprising:

a backing layer having a first side opposing a second side, said backing layer having a line of weakness, said second side having a first planar region and a second planar region on opposing sides of said line of weakness;

a pouch layer joined with said second side of said backing layer thereby forming a pouch, said pouch containing a stain treatment fluid; and a fluid pervious contact substrate joined to said first side of said backing layer proximal said line of weakness;

wherein said package has a first position in which said first planar region and said second planar region are substantially in plane with one another;

wherein said stain treatment fluid comprises from about 0.001% to about 99.99%, by weight of said stain treatment fluid, of a surfactant; and wherein said contact substrate has a first color and said first side of said backing layer has a second color, wherein said first color and said second color are measured by a Hunter Reflectance Meter test according to the colors L*, a*, and b*, L*, a*, and b* for said first color being measured on a surface of said contact substrate oriented away from said first side of said backing layer;

wherein said contact substrate extends between a pair of opposing widthwise edges on opposite sides of said line of weakness;

wherein more than about 25% of each said widthwise edge abuts a portion of said first side of said backing layer having said second color when said package is in said first position;

wherein said first color and said second color have a difference in color calculated using L*, a*, and b* values by the formula $\Delta E=[(L^*_X-L^*_Y)^2+(a^*_X-a^*_Y)^2+(b^*_X-b^*_Y)^7]^{1/7}$, wherein said ΔE between said first color and said second color is greater than about 10.

2. The package of claim 1, wherein said ΔE is greater than about 30.

3. The package of claim 1, wherein said ΔE is greater than about 50.

4. The package of claim 1, wherein said ΔE is greater than about 65.

5. The package of claim 1, wherein said first color has a L* value greater than about 80.

6. The package of claim 1, wherein said first color has a L* value greater than about 50.

7. The package of claim 1, wherein said second color has a L* value less than about 80.

8. The package of claim 1, wherein said second color has a L* value less than about 60.

9. The package of claim 1, wherein said contact substrate has a length dimension extending between said widthwise edges and orthogonal to a transverse axis oriented in the same general direction as said line of weakness, wherein at locations along said widthwise edge that abut said second color, said second color extends beyond said widthwise edge by more than about 10% of said length dimension of said contact substrate at said location along said widthwise edge.

10. The package of claim 9, wherein said second color extends beyond said widthwise edge by more than about 20% of said length dimension of said contact substrate at said location along said widthwise edge.

11. The package of claim 9, wherein said second color extends beyond said widthwise edge by more than about 30% of said length dimension of said contact substrate at said location along said widthwise edge.

12. The package of claim 9, wherein said second color extends beyond said widthwise edge by more than about 50% of said length dimension of said contact substrate at said location along said widthwise edge.

13. The package of claim 1, wherein more than about 50% of each said widthwise edge abuts a portion of said backing layer having said second color when said package is in said first position.

14. The package of claim 1, wherein more than about 75% of each said widthwise edge abuts a portion of said backing layer having said second color when said package is in said first position.

15. The package of claim 1, wherein more than about 90% of each said widthwise edge abuts a portion of said backing layer having said second color when said package is in said first position.

16. The package of claim 1, wherein about 100% of each said widthwise edge abuts a portion of said backing layer having said second color when said package is in said first position.

17. The package of claim 1, wherein said second color extends beyond said widthwise edge by more than about 2 mm.

18. The package of claim 1, wherein said first color is white.

19. The package of claim 18, wherein said second color is orange.

* * * * *